US007681551B2

(12) United States Patent
Konno

(10) Patent No.: US 7,681,551 B2
(45) Date of Patent: Mar. 23, 2010

(54) ELECTRIC COMPONENT SUPPORT STRUCTURE FOR MOTORCYCLE

(75) Inventor: Kenji Konno, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 416 days.

(21) Appl. No.: 11/723,727

(22) Filed: Mar. 21, 2007

(65) Prior Publication Data

US 2007/0221169 A1 Sep. 27, 2007

(30) Foreign Application Priority Data

Mar. 22, 2006 (JP) ..... 2006-078318

(51) Int. Cl.
*F02D 11/10* (2006.01)

(52) U.S. Cl. ..... 123/400

(58) Field of Classification Search ..... 123/647, 123/596, 337, 400

See application file for complete search history.

(56) References Cited

U.S. PATENT DOCUMENTS

| | | | | |
|---|---|---|---|---|
| 7,363,908 | B2 * | 4/2008 | Chida et al. | 123/399 |
| 2001/0023685 | A1 * | 9/2001 | Nawa et al. | 123/470 |
| 2001/0030071 | A1 * | 10/2001 | Okuma | 180/219 |
| 2005/0082104 | A1 * | 4/2005 | Miyakozawa et al. | 180/291 |
| 2005/0178364 | A1 * | 8/2005 | Kobayashi et al. | 123/470 |
| 2005/0217633 | A1 * | 10/2005 | Uneta et al. | 123/198 E |
| 2006/0042603 | A1 * | 3/2006 | Fukami et al. | 123/472 |
| 2006/0066092 | A1 * | 3/2006 | Miyabe | 280/833 |
| 2006/0157027 | A1 * | 7/2006 | Ichikawa et al. | 123/399 |
| 2006/0169248 | A1 * | 8/2006 | Chida et al. | 123/399 |

FOREIGN PATENT DOCUMENTS

| | | | |
|---|---|---|---|
| JP | 2005-219669 | A | 8/2005 |
| JP | 2007177682 | A * | 7/2007 |

* cited by examiner

*Primary Examiner*—Stephen K Cronin
*Assistant Examiner*—Arnold Castro
(74) *Attorney, Agent, or Firm*—Birch, Stewart, Kolasch & Birch, LLP

(57) ABSTRACT

A mounting structure on motorcycle for protecting a capacitor from vibration and heat. In an engine having an upright cylinder a throttle body is connected to an intake path of the cylinder via an insulator, and the throttle body is connected to an air cleaner via a connecting tube. The throttle body is thereby elastically supported relative to the engine and a vehicle body frame via the insulator and the connecting tube. A capacitor is disposed at a position downward of the throttle body. The capacitor is supported integrally with the throttle body using a lower portion of a throttle body cover that covers both left and right sides of the throttle body. A vibration isolating support structure is thus achieved for the capacitor by using the throttle body that is elastically supported.

19 Claims, 12 Drawing Sheets

ELECTRIC COMPONENT SUPPORT STRUCTURE FOR MOTORCYCLE

CROSS-REFERENCE TO RELATED APPLICATION

The present application claims priority under 35 U.S.C. §119 to Japanese Patent Application No. 2006-078318, filed Mar. 22, 2006, the entire contents of which are hereby incorporated by reference.

BACKGROUND OF THE INVENTION

1. Field of the Invention

The present invention relates to an electric component mounting structure in motorcycles, or more specifically, vehicles having electronic fuel injection systems.

2. Description of Background Art

A known arrangement, in a motorcycle mounted with an engine having an upright cylinder, makes use of a space rearward of the cylinder and upward of a crankcase to dispose therein capacitors and other electric components, so that the electric components are supported on an upper surface of the crankcase. For example, see Japanese Patent Laid-open No. 2005-219669.

A problem with the known arrangement is that, because the electric components are fixed to the engine, it is necessary to adopt electric components that offer high vibration resistance or to dispose an elastic member having a large capacity between the electric components and the engine. It is therefore an object of the present invention to provide a simple arrangement for achieving vibration isolating support for even an electric component susceptible to vibration.

SUMMARY AND OBJECTS OF THE INVENTION

To solve the foregoing problem of the known arrangement, an electric component support structure for a motorcycle according to a first claim of the present invention is applicable to a motorcycle that includes an intake path and a throttle body. The intake path is for supplying air for an engine. The throttle body has a built-in throttle for adjusting an amount of air supplied to the intake path. The throttle body is connected to the intake path via an insulator formed from an elastic body. In the motorcycle having arrangements as described above, an electric component is supported by the throttle body.

According to a second aspect of the present invention, the throttle body is connected to an air cleaner fixed to a vehicle body via a connecting tube formed of an elastic body.

According to a third aspect of the present invention, the electric component includes a capacitor covered with a holder formed of an elastic material. Further, the holder is mounted to the throttle body, which supports the electric component on the throttle body.

An electric component support structure for a motorcycle according to a fourth aspect of the present invention is applicable to a motorcycle that includes an engine disposed between a front wheel and a rear wheel. The engine includes a crankcase disposed downward and a cylinder extending upwardly of the crankcase. The cylinder includes an intake port opening rearwardly from an upper portion thereof. The intake port is connected to a throttle body via an insulator formed of an elastic body. The throttle body is connected to an air cleaner box via a connecting tube formed of an elastic body. In the motorcycle having arrangements as described above, an electric component is supported downwardly of the throttle body.

According to a fifth aspect of the present invention, in the arrangements according to any of the first to fourth claims of the present invention, the throttle body includes a throttle body cover mounted so as to cover an outside of the throttle body. Further, the electric component is supported on the throttle body cover.

According to a sixth aspect of the present invention, in the arrangements according to the fifth claim of the present invention, the throttle body cover is previously divided into left- and right-hand side halves and the left- and right-hand side halves are mounted so as to sandwich the throttle body. The left- and right-hand side halves are connected together at a connection downward of the throttle body during mounting. The connection is inserted into a slit formed in the electric component so that the electric component is supported.

EFFECTS OF THE INVENTION

In the electric component support structure according to the first aspect of the present invention, the throttle body, to which vibration from the engine is less likely to be transmitted, can be used to support the electric component, thus achieving an advantageous vibration isolating support structure. This allows an electric component that is not resistant to vibration to be adopted and an elastic body disposed between the electric component and the throttle body to have a small capacity. As a result, reduction in weight can be achieved.

In the electric component support structure according to the second aspect of the present invention, the throttle body is connected to the vehicle body side also via the connecting tube made of an elastic body. As a result, vibration from the vehicle body is less likely to be transmitted, making the structure an even more advantageous vibration isolating support structure.

In the electric component support structure according to the third aspect of the present invention, the capacitor as an electric component is supported onto the throttle body via the holder formed from an elastic material covering the capacitor. Accordingly, elasticity of the holder is added to elasticity of the insulator and the connecting tube supporting the throttle body onto the engine and the vehicle body side, respectively. The capacitor is thus elastically supported. Support offering an even greater vibration isolation performance can therefore be provided for the capacitor that is susceptible to vibration.

In the electric component support structure according to the fourth aspect of the present invention, the electric component is supported downward relative to the throttle body which is elastically supported onto the engine and the vehicle body side via the insulator and the connecting tube. This permits mounting of the electric component in a condition, in which vibration is less likely to be transmitted to the electric component. At the same time, a space surrounded by the throttle body, the cylinder, and the crankcase can be used effectively. This results in enhanced space utilization efficiency in layout of the electric component.

In the electric component support structure according to the fifth aspect of the present invention, the electric component can be supported by making use of the throttle body cover that is mounted to the throttle body. This eliminates the need for a dedicated electric component support member. As a result, the number of parts used can be reduced and the support structure can be simplified. Moreover, the electric component can be covered with the throttle body cover, which blocks off heat from the engine for the electric component.

In the electric component support structure according to the sixth aspect of the present invention, the throttle body cover is previously divided into left- and right-hand side halves and then the left- and right-hand side halves are mounted so as to sandwich the throttle body. The left- and right-hand side halves are further connected together at a connection downward of the throttle body during mounting. Accordingly, the electric component can be easily supported by simply inserting the connection into the slit previously formed on the side of the electric component.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
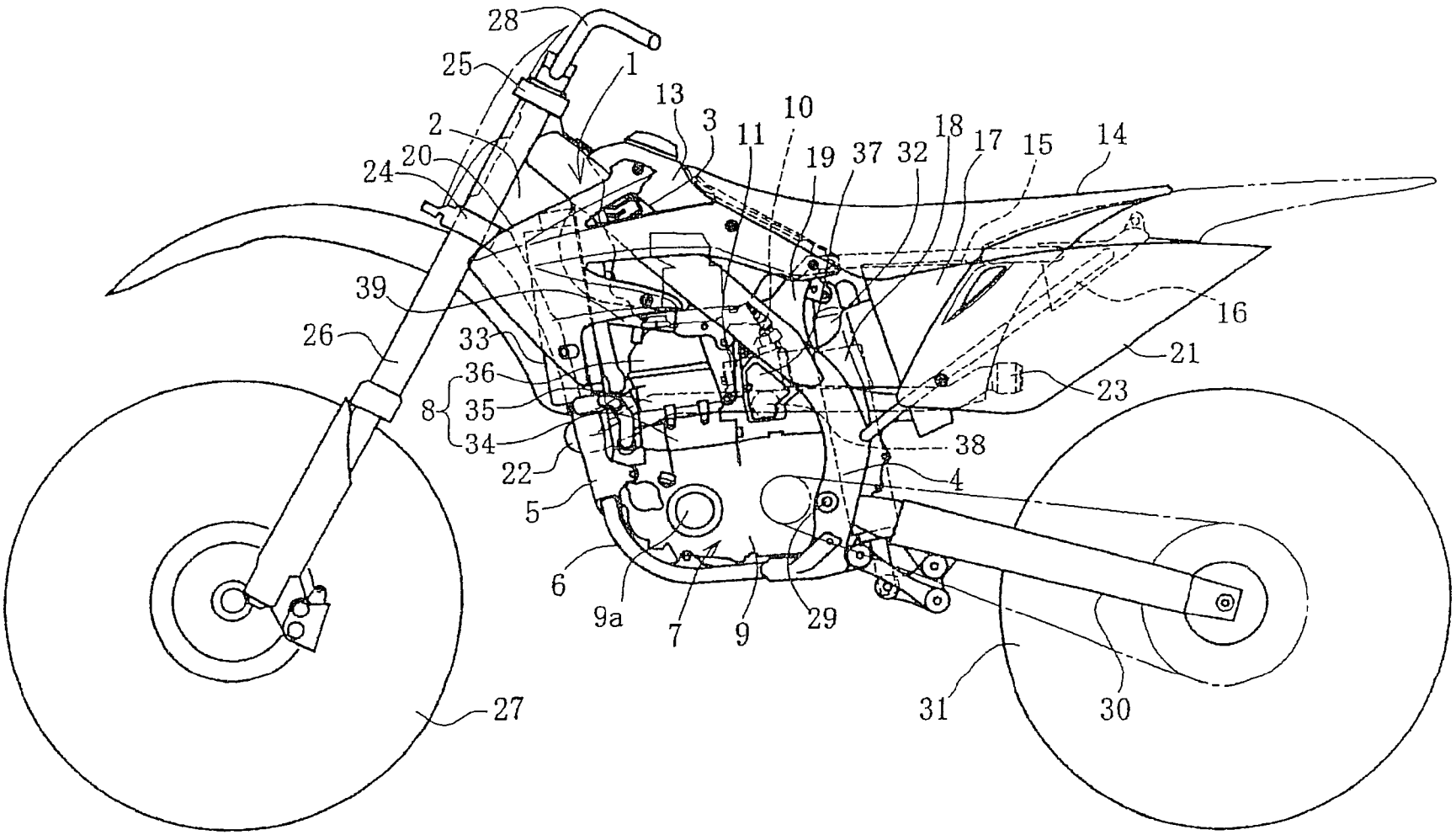
FIG. 1 is a side elevational view showing a motorcycle in accordance with an embodiment of the present invention.

A specific embodiment to which the present invention is applied will be described below with reference to the accompanying drawings. FIG. 1 is a side elevational view showing an offroad motorcycle, to which the embodiment of the present invention is applied. A vehicle body frame 1 of this motorcycle includes a head pipe 2, a main frame 3, a center frame 4, a down frame 5, and a lower frame 6. Each of these members is connected to each other to form a loop, inside which an engine 7 is supported. Each of the main frame 3, the center frame 4, and the lower frame 6 is provided in pairs of left and right members. The head pipe 2 and the down frame 5 constitute a single member extended along a center of a vehicle body.

The main frame 3 is extended in a straight line obliquely downwardly toward a rear in a space upward of the engine 7. The main frame 3 is then connected to an upper end portion of the center frame 4 that extends in a vertical direction in a space rearward of the engine 7. The down frame 5 is extended obliquely downwardly at a position forward of the engine 7. The down frame 5 has a lower end portion connected to a front end portion of the lower frame 6. The lower frame 6 is bent downwardly of the engine 7 from a lower portion on a front side of the engine 7. The lower frame 6 is then extended rearwardly substantially in a straight line. The lower frame 6 has a rear end portion connected to a lower end portion of the center frame 4.

The engine 7 includes an upright cylinder 8 and a crankcase 9. A well-known throttle body 10 is disposed at a position rearward of the cylinder 8. The throttle body 10 has a built-in throttle valve (to be described later) that regulates the amount of intake air. The throttle body 10 is mounted with an electronic fuel injection nozzle (to be described later). The throttle body 10 has a front end portion connected to an intake port (to be described later) of the cylinder 8 via an insulator 11 formed from a rubber or other elastic body. A mixture of fuel and air is thereby supplied from the throttle body 10 to a side of the cylinder 8.

A fuel tank 13 is disposed upward of the cylinder 8. A seat 14 is disposed rearward of the fuel tank 13. A back stay 16 is disposed downward of a seat rail 15. An air cleaner 17 is supported on the seat rail 15 and the back stay 16. Purified air is thereby drawn in from the rear of the vehicle body via a connecting tube 18 to an intake port that serves as an intake upstream side of the throttle body 10. Also shown are a front side cover 20 and a rear side cover 21.

An exhaust pipe 22 is extended forwardly from a front portion of the cylinder 8. The exhaust pipe 22 is then bent and extended rearwardly. The exhaust pipe 22 is further extended along a side of the cylinder 8 and connected to a muffler (not shown). A rear end portion 23 of the exhaust pipe 22 is supported by the back stay 16 at a portion rearward of the center frame 4.

A front fork 26 has an upper portion supported on the head pipe 2 via a top bridge 25 and a bottom bridge 24. A front wheel 27 is supported on a lower end portion of the front fork 26. The front wheel 27 is steered by a handlebar 28. A front end portion of a rear arm 30 is swingably supported via a pivot 29 on the center frame 4. The rear arm 30 supports a rear wheel 31 on a rear end portion thereof. The rear wheel 31 is driven through chain drive by the engine 7. A cushion unit 32 of a rear suspension is disposed between a stay 19 that protrudes upwardly from a rear portion of the main frame 3 and the rear arm 30.

Figure 2:
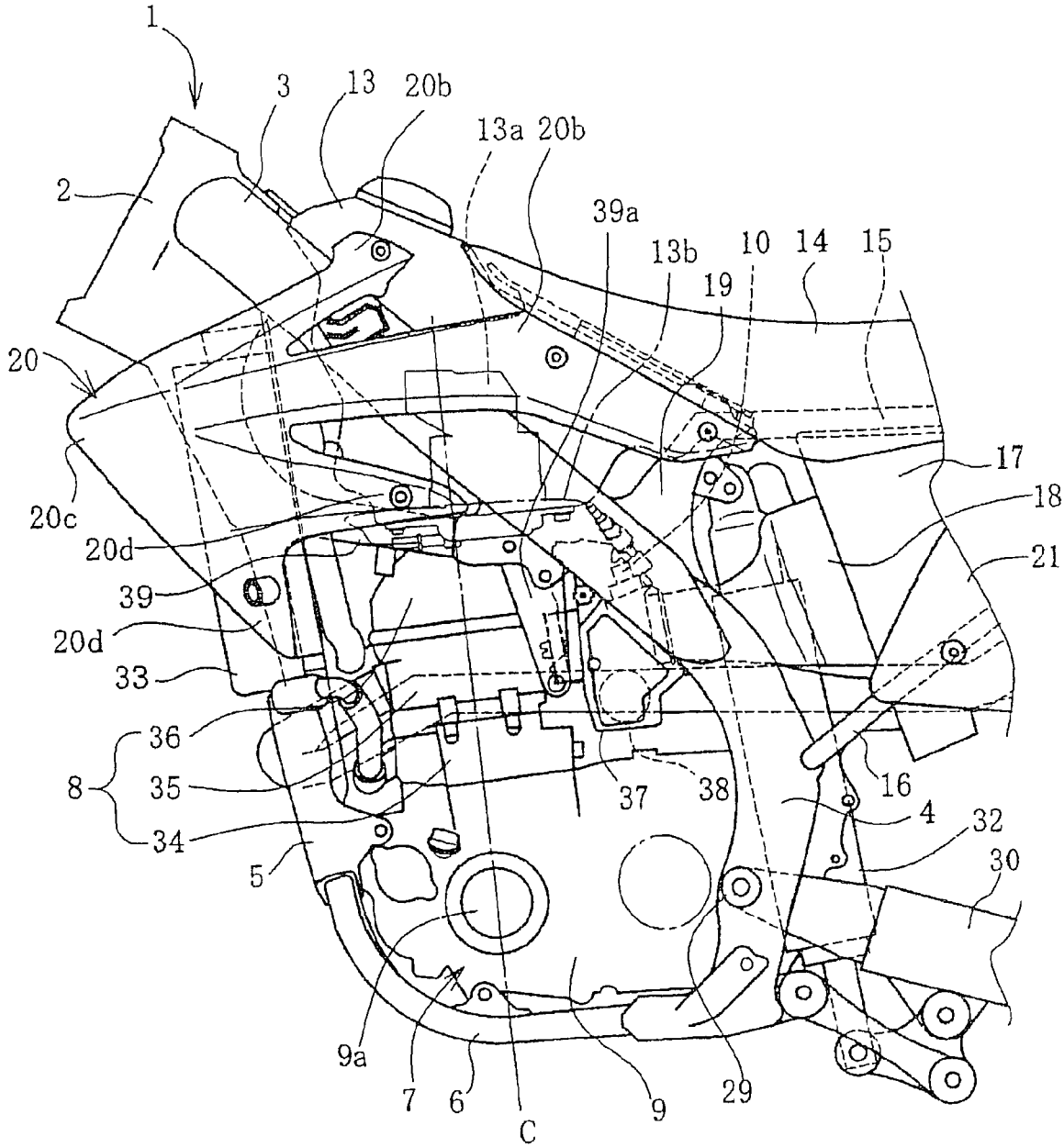
FIG. 2 is an enlarged side elevational view showing a front portion of a vehicle body.

FIG. 2 is an enlarged side elevational view showing a front portion of the vehicle body including the engine 7. The engine 7 is a water-cooled four-cycle engine cooled by a radiator 33. The cylinder 8 is disposed at a front portion of the crankcase 9 in an upright position with a cylinder axis C thereof extending substantially vertically. The cylinder 8 includes a cylinder block 34, a cylinder head 35, and a head cover 36 disposed in that order from a bottom upward. The cylinder 8, being disposed in the upright position, allows a piston (not shown) to have a long stroke and the engine 7 to have a short longitudinal length. This makes the engine 7 just right for the offroad vehicle.

The fuel tank 13, disposed immediately upwardly of the cylinder 8, has a built-in type fuel pump 13*a* accommodated therein. There is a clearance equivalent to about the size of a stiffener portion 39 between a bottom portion of the fuel tank 13 and an upper portion of the head cover 36. The stiffener portion 39 is an arm-shaped frame reinforcement member that connects a middle portion in the vertical direction of the down frame 5 with a rear portion of the main frame 3.

The fuel pump 13*a* is disposed immediately upwardly of the cylinder 8 so as to overlap the cylinder axis C. The fuel pump 13*a* is connected to the fuel injection nozzle (to be described later) of the throttle body 10 via a fuel supply pipe 13*b* that extends from a delivery port protruded downwardly from a bottom portion of the fuel tank 13. This arrangement helps make the fuel supply pipe 13*b* relatively shorter, reduce fuel pressure loss, and reduce overall weight.

The throttle body 10 is covered with a throttle body cover 37 from a left- and right-hand side. The throttle body cover 37 is formed from a resin or other appropriate type of material. An upper portion on the rear side of the throttle body cover 37 extends along a lower end of the main frame 3 and the throttle body cover 37 can be removed to the left and right without allowing the cover 37 to interfere with the main frame 3. A capacitor 38 is accommodated at a lower portion on the inside of the throttle body cover 37 and supported at a position downward of the throttle body 10.

The capacitor 38 constitutes a battery-less power supply system. Electricity generated by an AC generator 9*a* of the engine 7 is supplied to different parts that need electricity of the vehicle, including, for example, a high voltage current being applied to an ignition plug (not shown) of the cylinder 8. The capacitor 38 is an example of the electric components susceptible to vibration and heat for which the present invention is intended.

The front side cover 20 is formed from a resin or other appropriate type of material. The front side cover 20 is branched into four arm portions that gradually widen toward the rear. An upper arm, which extends obliquely upwardly toward the rear from a main body portion 20*a*, reaches a front portion on a side surface of the fuel tank 13, to which a leading end of the upper arm is attached. A first middle arm 20*b* that extends rearwardly substantially horizontally reaches a front edge of the seat 14. The first middle arm 20*b* is connected to a rear portion on a side surface of the fuel tank 13 and the stay 19 that protrudes upwardly from a rear portion of the main frame 3.

A second middle arm 20*c*, which extends slightly obliquely downwardly toward the rear along a portion downward of the first middle arm 20*b*, crosses partly the stiffener portion 39 to extend up to a lower portion on the front side on the side surface of the fuel tank 13, at which the second middle arm 20*c* is connected to a bottom portion of the fuel tank 13. A lower arm 20*d* that extends downwardly overlaps a side surface of the down frame 5 is fastened thereto.

The main body portion 20*a* of the front side cover 20 has a front end protruding further forwardly relative to the down frame 5 and the radiator 33 and downwardly relative to the head pipe 2. The main body portion 20*a* serves as a cover that covers a side surface of the radiator 33 and guides wind thereto. Reference numeral 39*a* represents an engine hanger. The engine hanger 39*a* extends downwardly from a rear end portion of the stiffener portion 39 and alongside the insulator 11 to support the cylinder head 35.

Figure 3:
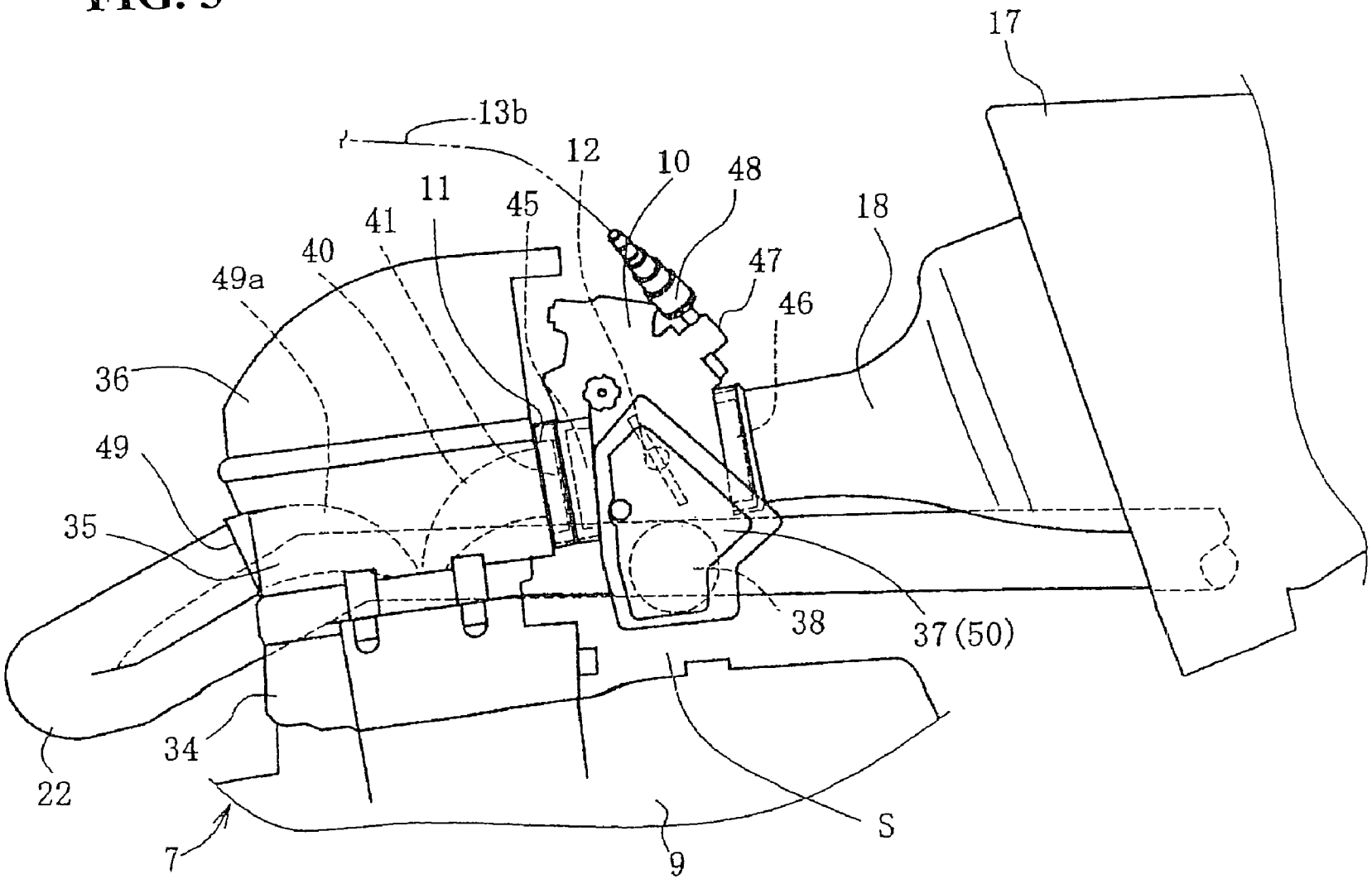
FIG. 3 is a view showing a construction of an intake system portion.

FIG. 3 is a view showing mainly an intake system portion in FIG. 2. An intake path 40 formed to extend obliquely upwardly from an inside of the cylinder head 35 toward a back surface thereof includes an intake port 41 at a trailing end. A forward end portion of the insulator 11 is fitted to the intake port 41. Further, a trailing end portion of the insulator 11 is connected to a delivery port 45 that opens to a front side of the throttle body 10. A front end portion of the connecting tube 18 is connected to an intake port 46 that opens in a back surface side of the throttle body 10.

The connecting tube 18 is formed from a rubber or other appropriate type of elastic material. The connecting tube 18 provides an elastic support for the throttle body 10 onto the side of the vehicle body frame 1 by way of the air cleaner 17 supported on the vehicle body frame 1. Air purified by the rearward air cleaner 17 is sent to an upstream side of a throttle valve 12 from the intake port 46 of the throttle body 10 via the connecting tube 18. The amount of intake air relative to the intake port 41 is regulated by varying an opening of the throttle valve 12.

The throttle body 10 includes a fuel injection nozzle 47 mounted an upper portion thereof. The fuel injection nozzle 47 injects fuel supplied from the fuel supply pipe 13*b* connected to a joint 48 toward the intake port 41 into a downstream side of the throttle valve 12.

A lower portion of the throttle body cover 37, in which the capacitor 38 is accommodated, is extended into a space S available downward of the throttle body 10, rearward of the cylinder 8, and upward of the crankcase 9. The capacitor 38 is disposed in the space S downward of the throttle body 10 and supported by the throttle body 10 via the throttle body cover 37. Referring to FIG. 3, reference numeral 49 represents an exhaust port and reference numeral 49*a* represents an exhaust path.

Figure 4:
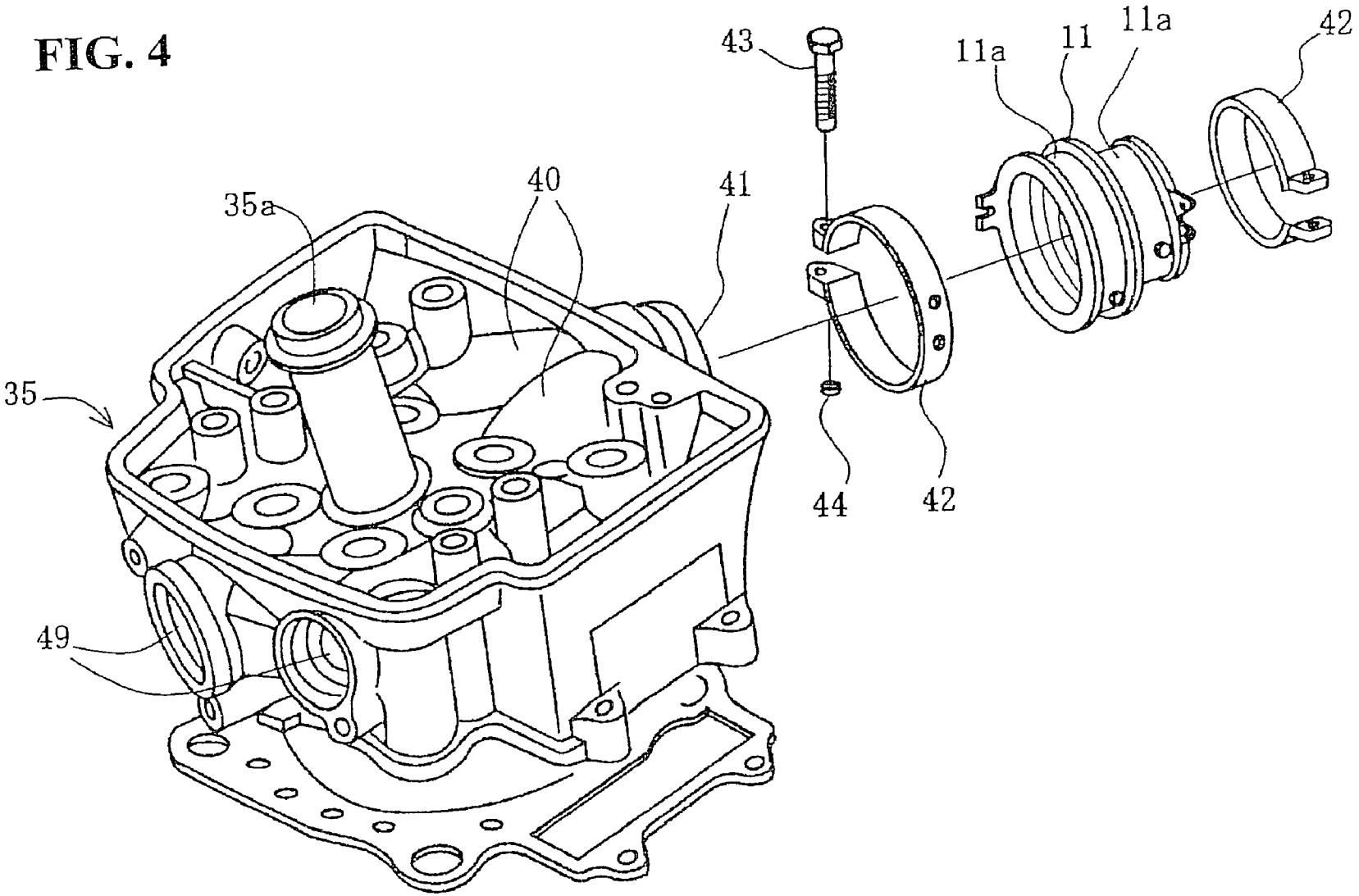
FIG. 4 is a view showing mounting of an insulator relative to a cylinder head.

FIG. 4 is a view showing mounting of the insulator 11 relative to the cylinder head 35. The intake path 40 is bifurcated inside the cylinder head 35 and the bifurcation merges into the single intake port 41 on an intake upstream side, protruding rearwardly from a back surface of the cylinder head 35. The forward end portion of the insulator 11, which is formed from a rubber or other elastic material, is fitted to the intake port 41. Then, a clamp band 42 is wound around the insulator 11, so that the insulator 11 is finally secured with a bolt 43 and a nut 44.

Similarly, a rearward portion of the insulator 11 is connected and secured, using another clamp band 42, to the delivery port 45 that opens to the front side of the throttle body 10. The throttle body 10 is therefore elastically supported on the cylinder head 35 via the insulator 11 which is an elastic member. Referring to FIG. 4, reference numeral 35*a* represents a plug hole, into which the ignition plug is inserted.

Figure 5:
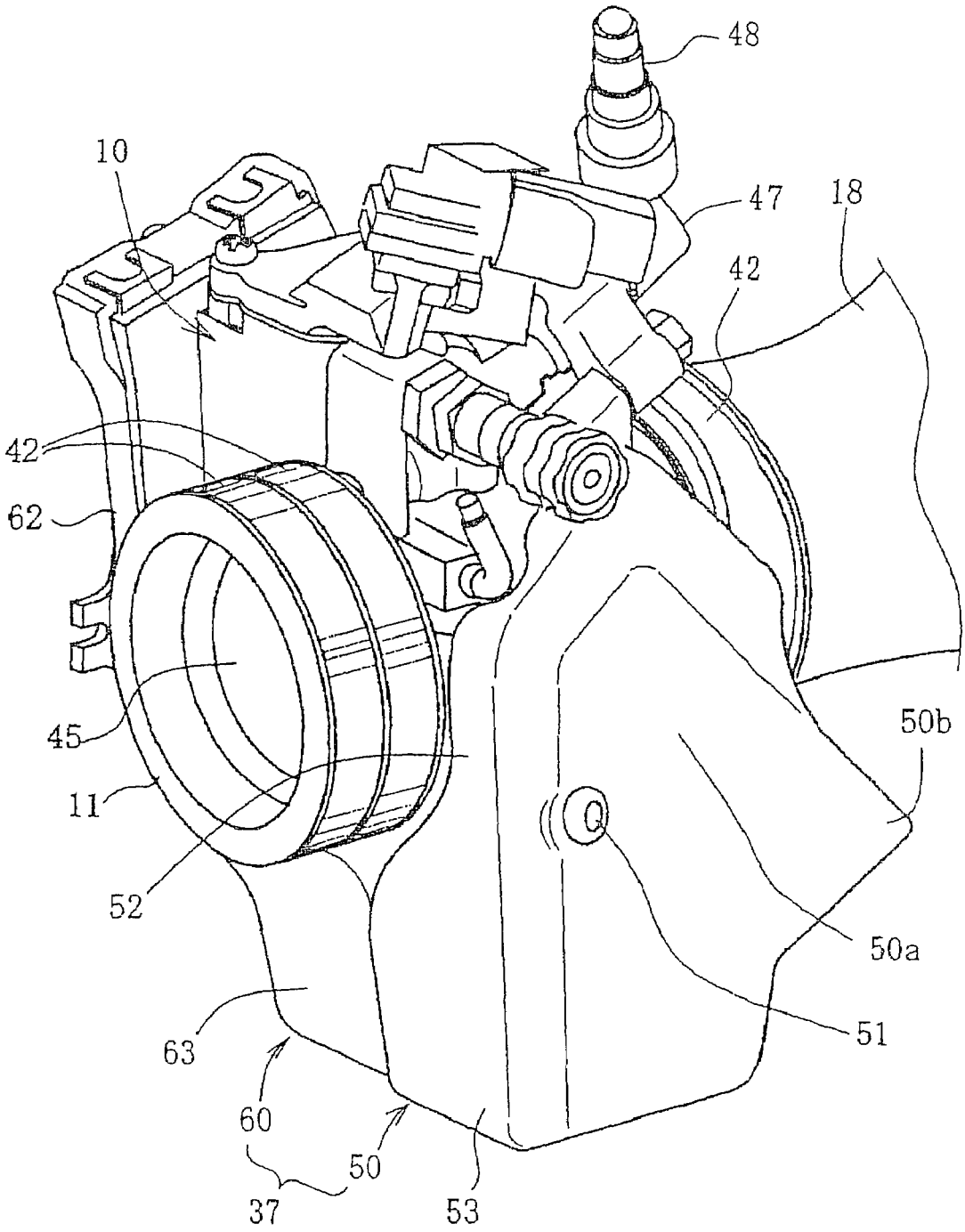
FIG. 5 is a left side perspective view showing a throttle body portion.

FIG. 5 is a perspective view showing the throttle body 10 and portions surrounding the throttle body 10 as viewed from an obliquely left forward direction. The delivery port 45 mounted with the insulator 11 opens in the front surface of the throttle body 10. A left cover 50 is removably secured with a screw 51 to a left side surface of the throttle body 10. The left cover 50 forms the left-hand side half of the throttle body cover 37 and is positioned by being placed over the throttle body 10 from the side of a left side surface thereof. The left cover 50 can therefore be fixed in position by simply fastening a side surface of a main body portion 50*a* to the left side surface of the throttle body 10 using the single screw 51.

A front portion of the main body portion 50*a* in the left cover 50 forms a front wall 52 that extends to the front surface on the left side of the throttle body 10. A lower portion of the main body portion 50*a* forms a holder portion 53 that covers a bottom portion of the throttle body 10 with some clearance upward. The holder portion 53 includes a continuation of a bottom portion that extends along the bottom portion of the throttle body 10 to the left side and a downward extended portion of the front wall 52, the continuation surrounding a downward space of the bottom portion of the throttle body 10. The main body portion 50*a* includes a protruded portion 50*b* formed integrally therewith at a rear portion thereof and protruding rearwardly. The protruded portion 50*b* covers a connector of a sensor to be described later.

Figure 6:
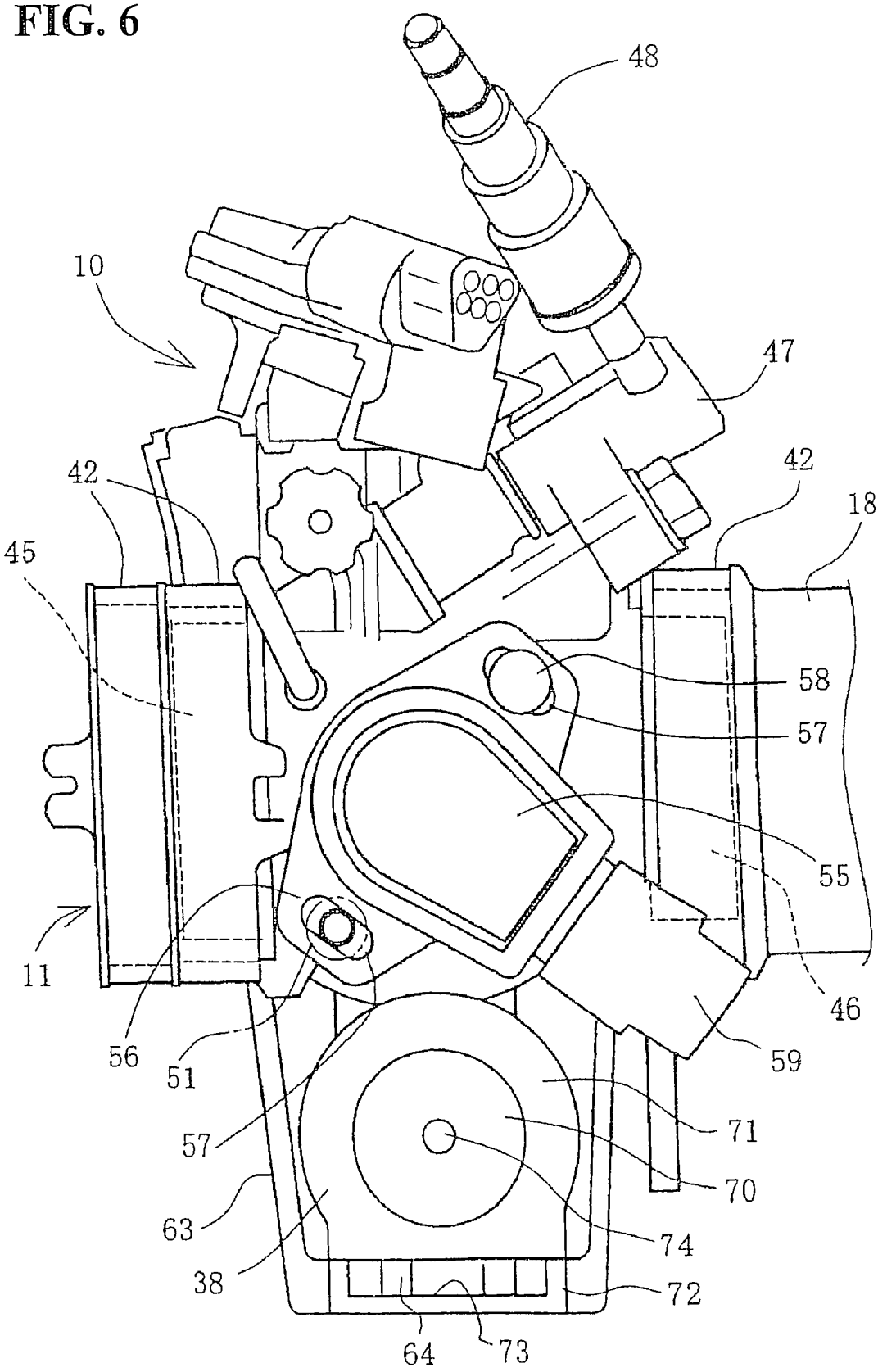
FIG. 6 is a left side elevational view showing the throttle body portion with a cover removed.

FIG. 6 is a left side elevational view showing the throttle body 10 and portions therearound with the left cover 50 removed (with a right cover 60 mounted). A sensor 55 for detecting an opening of the throttle valve 12 is mounted on the left side surface of the throttle body 10. The sensor 55 is mounted to the throttle body 10 by being fastened to the throttle body 10 with a screw 58 inserted in a slot 57 in a bracket 56.

There are two such mounting locations across the sensor 55, being symmetrical with each other. The screw 51 installed in a lower mounting location of the two mounting locations is adapted to be used to fasten jointly the left cover 50 and the sensor 55. It is nonetheless perfectly okay to use a fastening screw each for the sensor 55 and the left cover 50. In this case, too, the fastening location can be at one place if a nut portion for fastening the screw 51 of the left cover 50 is formed in a flange portion of the fastening screw of the sensor 55.

The left cover 50 covers the left side surface of the throttle body 10 such that the main body portion 50*a* covers the sensor 55. Referring to FIG. 6, reference numeral 46 represents the intake port that opens rearwardly from the back surface side of the throttle body 10. The front end portion of the connecting tube 18 is connected to the intake port 46 and secured with the clamp band 42. Reference numeral 59 represents a connector of the sensor 55. The connector 59 protrudes obliquely downwardly toward the rear and is covered by the protruded portion 50*b* of the left cover 50.

Figure 7:
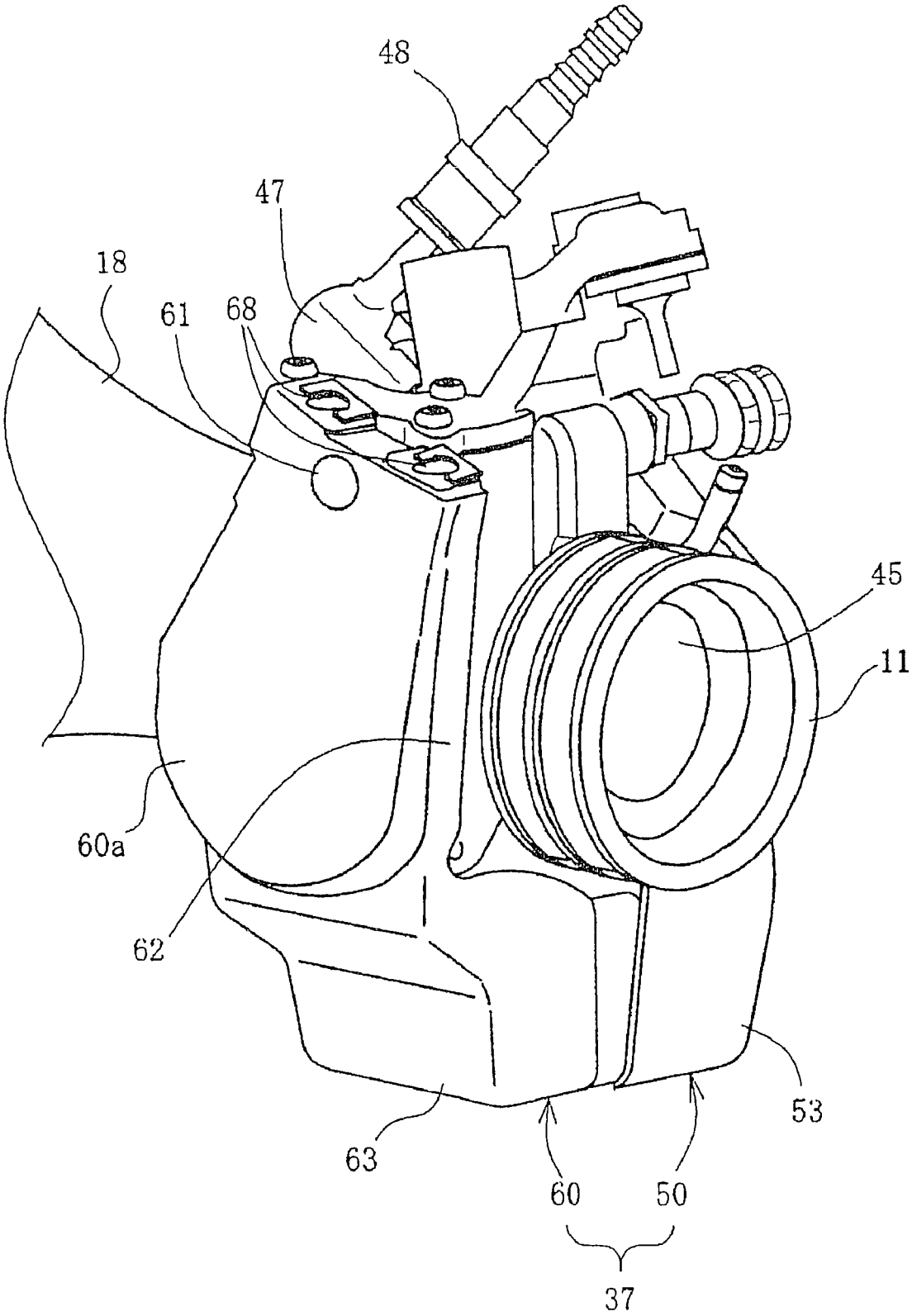
FIG. 7 is a right side perspective view showing the throttle body portion.

FIG. 7 is a view showing the throttle body 10 and portions therearound, as viewed from an obliquely right front side. A right side surface of the throttle body 10 is covered by the right cover 60. The right cover 60 is positioned when a right side of the throttle body 10 is fitted to the right cover 60. Accordingly, an upper portion of a main body portion 60*a* is fixed to the right side surface of the throttle body 10 with only a single screw 61.

The main body portion 60*a* includes a front portion that serves as a front wall 62. The front wall 62 extends to cover a front surface right-hand side half side of the throttle body 10. The main body portion 60*a* also includes a lower portion that forms a holder portion 63. The holder portion 63 covers a bottom portion of the throttle body 10 with some clearance upward. The holder portion 63 includes a continuation of a bottom portion that extends along the bottom portion of the throttle body 10 to the right side and a downward extended portion of the front wall 62, the continuation surrounding a downward space of the bottom portion of the throttle body 10.

Figure 8:
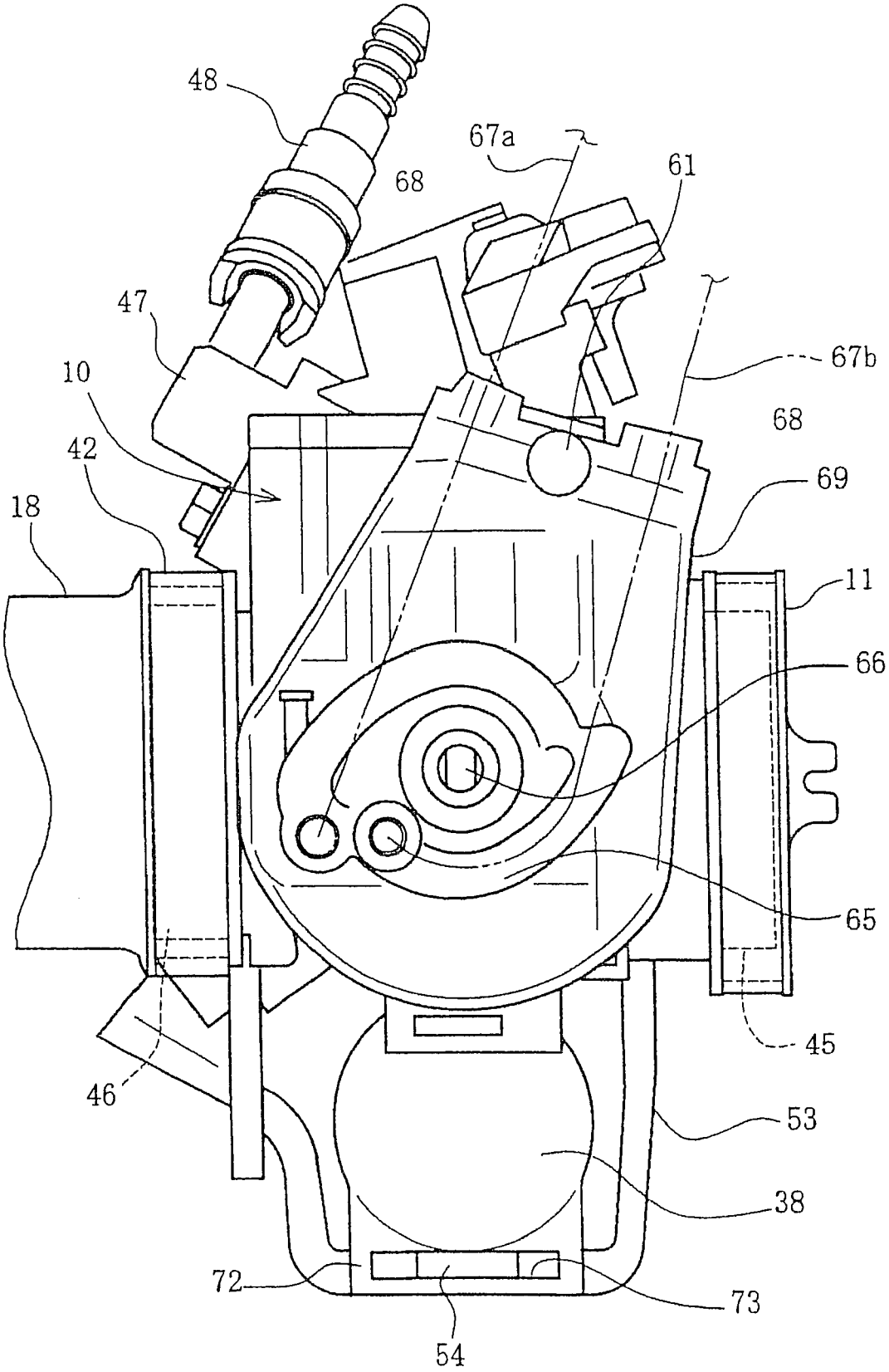
FIG. 8 is a right side elevational view showing the throttle body portion with a cover removed.

FIG. 8 is a right side elevational view showing the throttle body 10 and portions therearound with the right cover 60 removed (with the left cover 50 mounted). A pulley 65 for opening and closing the throttle valve 12 is mounted on the right side surface of the throttle body 10, pivotally movably about a pivot 66. The pulley 65 is rotatable in a forward and backward direction by a pair of wires 67*a*, 67*b*. Each of the wires 67*a*, 67*b* is extended upwardly in FIG. 8 from a guide groove 68 in an upper portion of a side surface. The pulley 65 and the wires 67*a*, 67*b* are surrounded by a guide wall 69. The main body portion 60*a* of the right cover 60 is fitted over the guide wall 69, the main body portion 60*a* covering the pulley 65 and the wires 67*a*, 67*b*.

Figure 9:
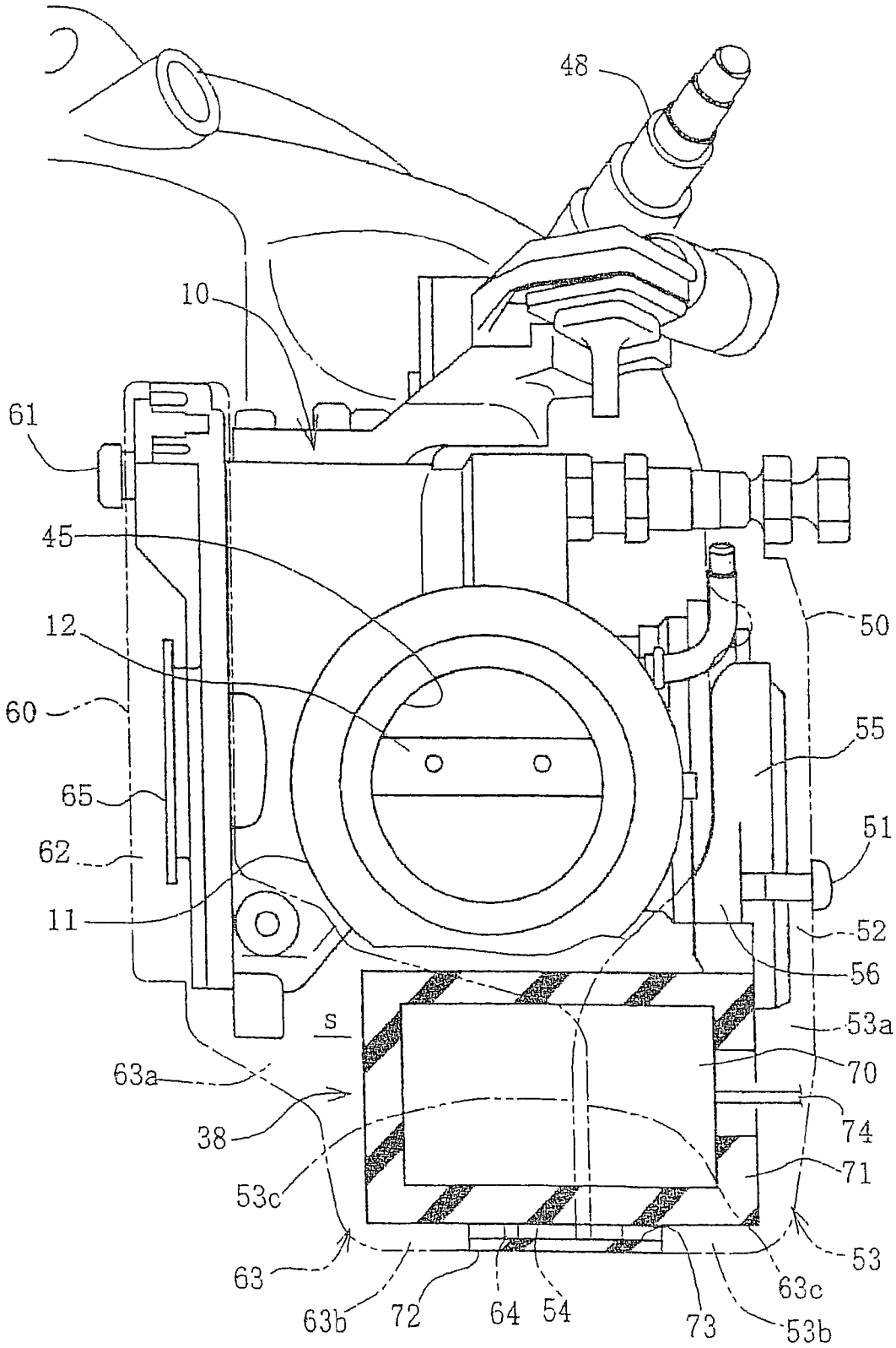
FIG. 9 is a front view showing the throttle body portion.

FIG. 9 is a front view showing the throttle body 10. The left cover 50 and the right cover 60 are brought together from either side into an integrated body, the front wall 52 and the front wall 62 serving as a front wall 53*a* of the holder portion 53 and a front wall 63*a* of the holder portion 63, respectively, at a position downward of the insulator 11. There is provided a space s between a bottom surface of the throttle body 10 and a bottom portion 53*b* of the holder portion 53, and between the bottom surface of the throttle body 10 and a bottom portion 63*b* of the holder portion 63, respectively. The capacitor 38 is accommodated in the space s. The left cover 50 and the right cover 60 serve not only as a cover for the throttle body 10, but also as a support and protective holder for the capacitor 38.

Figure 10:
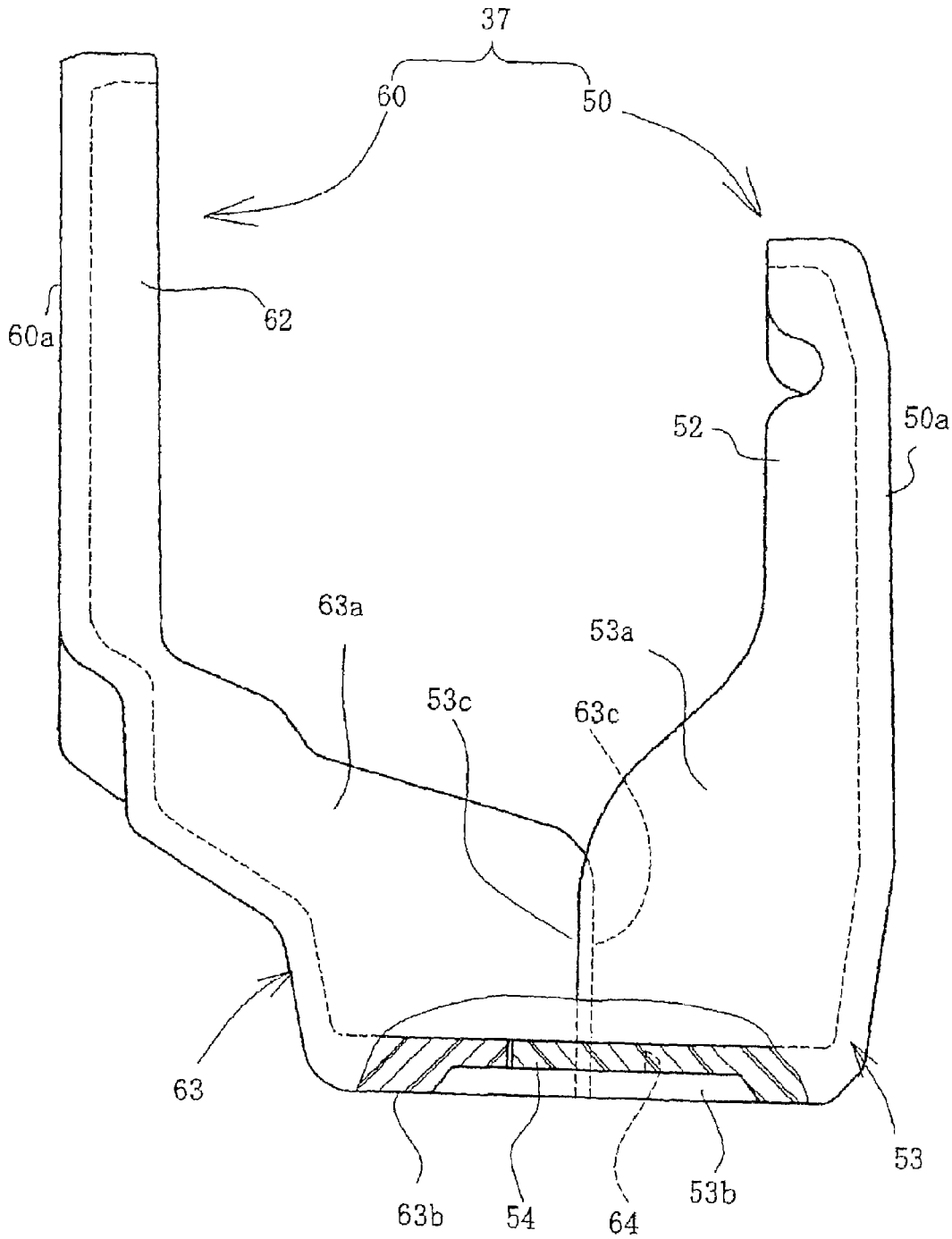
FIG. 10 is a front view showing a throttle body cover.

FIG. 10 is a partly cutaway view showing only the left cover 50 and the right cover 60 in the condition shown in FIG. 9. FIG. 10 shows the holder portions 53, 63 and the bottom portions 53*b*, 63*b*, on which a tongue 54 and a bifurcate portion 64 are formed. The tongue 54 and the bifurcate portion 64 are retracted in the form of an upward step so that a space, in which part of a band portion (to be described later) of the capacitor 38 fits, can be formed downward thereof. The front walls 53*a*, 63*a* of the holder portions 53, 63 have inner edge portions 53*c*, 63*c*, respectively. The inner edge portions 53*c*, 63*c* are mated together from respective sides and brought into a mutually overlapped condition, so that the holder portions 53, 63 are integrated together as a continued structure.

Figure 11:
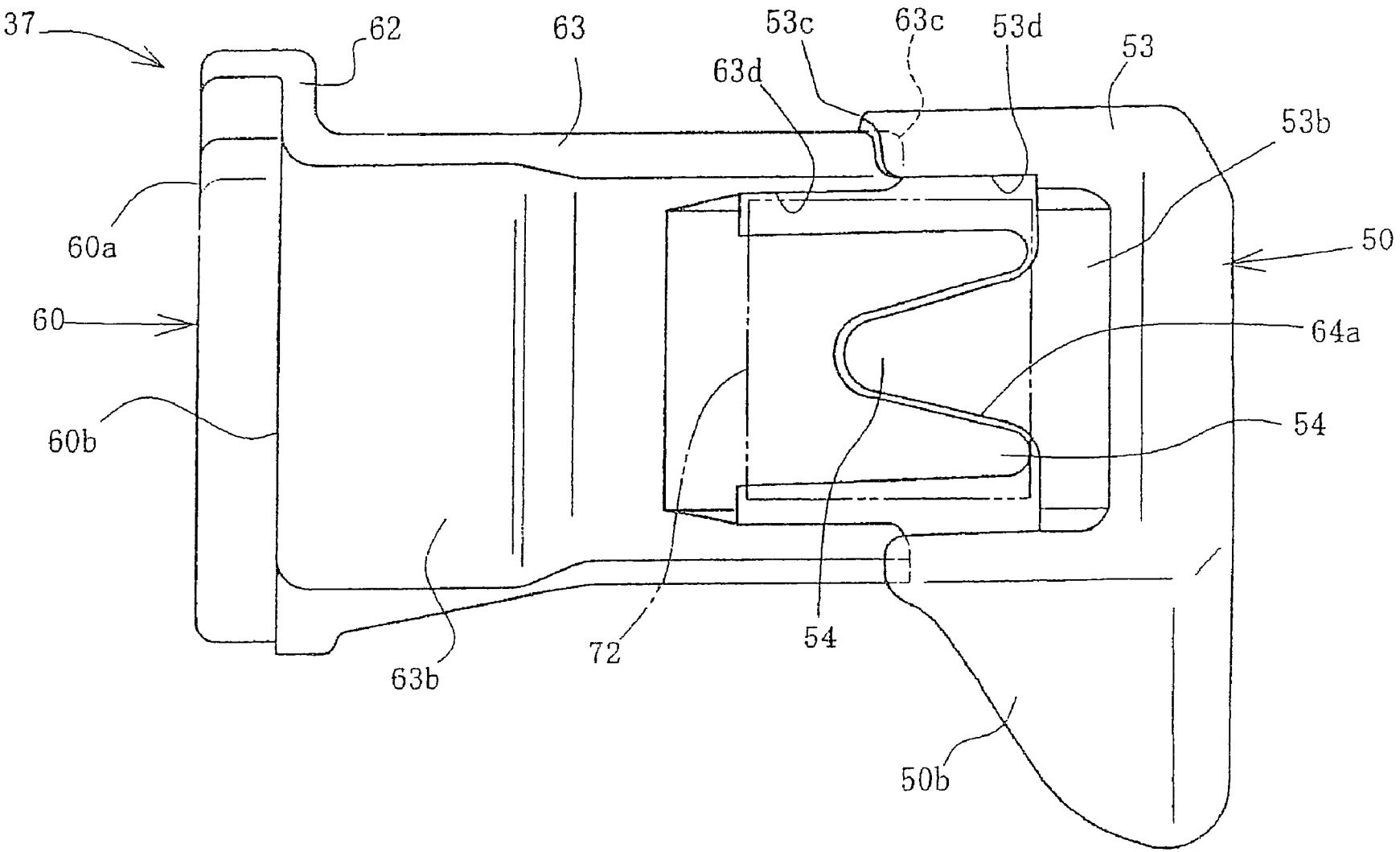
FIG. 11 is a bottom view showing the throttle body cover.

FIG. 11 is a bottom view showing the throttle body cover 37 in a condition, in which the holder portion 53 and the holder portion 63 are connected together. As evident from FIG. 11, the bottom portion 53*b* of the holder portion 53 includes the tongue 54 formed at a center thereof. The tongue 54 protrudes toward the side of the holder portion 63. The bottom portion 63*b* of the holder portion 63, on the other hand, includes the bifurcate portion 64. The bifurcate portion 64 has a recess 64*a*, in which the tongue 54 fits. The bifurcate portion 64 includes slits 53*d*, 63*d* disposed on an outside thereof.

Figure 12:
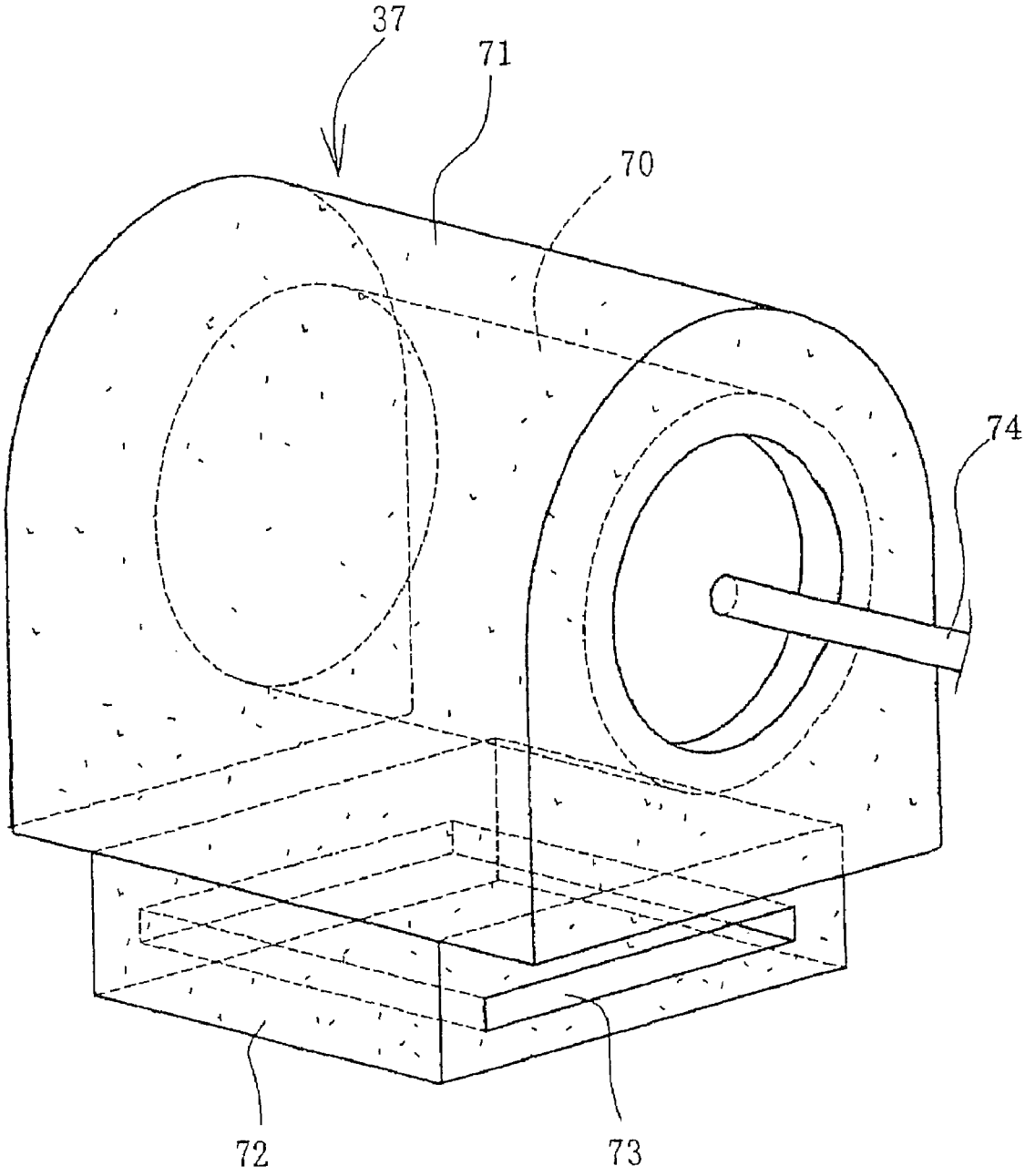
FIG. 12 is a perspective view showing a capacitor.

FIG. 12 is a perspective view showing the capacitor 38. A capacitor main body 70 is of a cylindrical form. An elastic holder 71, formed from a coating of a rubber or other appropriate type of elastic material, integrally covers the capacitor main body 70. The elastic holder 71 thus elastically supports the capacitor main body 70 to ensure good vibration isolation. The elastic holder 71 includes a thick-wall band portion 72 that protrudes downwardly and is integrally formed therewith. The band portion 72 includes a slit 73 that penetrates therethrough in a lateral direction of the thick wall.

The capacitor main body 70 has a first side surface, on which the elastic holder 71 is not partly formed and from which an electric wire 74 is extended outwardly.

Referring back to FIG. 9, the capacitor 38 placed on the holder portions 53, 63 is disposed such that the slit 73 in the band portion 72 at a bottom portion of the capacitor 38 is open in the lateral direction. The tongue 54 and the bifurcate portion 64 are inserted into the slit 73 from respective sides, so that the capacitor 38 is positioned and fixed in the vertical direction.

At this time, referring to a phantom line of FIG. 11, sides (portions extending along outer sides of the bifurcate portion 64) of the band portion 72 fit into the slits 53*d*, 63*d*, so that the band portion 72 is positioned in a direction (longitudinal direction) perpendicular to a direction in which the slit 73 penetrates. Further, the band portion 72 is positioned in the lateral direction at end portions in the lateral direction of the slits 53*d*, 63*d*. At the same time, the capacitor main body 70 is positioned in the lateral direction at side wall portions of the holder portions 53, 63.

Effects of the embodiment of the present invention will be described below. The throttle body 10 supporting the capacitor 38 is elastically supported by the insulator 11 relative to the engine 7 and via the connecting tube 18 relative to the vehicle body frame 1. Accordingly, the throttle body 10 is supported in a vibration isolated manner by the engine 7 and the vehicle body frame 1. Further, the capacitor 38 supported by the throttle body 10 is supported in a vibration isolated manner by making use of elasticity of the insulator 11 and the connecting tube 18 provided for elastically supporting the throttle body 10. The capacitor 38, which is susceptible to vibration, is thereby supported in a vibration isolated manner.

The foregoing arrangements allow an elastic support structure for dedicated use for the capacitor 38 to be eliminated or simplified. According to the embodiment of the present invention, the capacitor 38 is provided with the elastic holder 71 to provide an elastic support for the capacitor main body 70. The elastic holder 71 can therefore be made to have a wall as thin as possible, contributing to reduction in overall weight. The elastic holder 71 may even be eliminated.

Accordingly, the throttle body 10, to which vibration from the engine 7 is less likely to be transmitted, can be used to support electric components in a vibration isolated manner. This allows an electric component that is not resistant to vibration to be adopted and an elastic body disposed between the electric component and the throttle body to have a small capacity. As a result, reduction in the number of parts used, size, and weight can be achieved.

The vibration isolating support structure as described above allows the electric component to be disposed near the engine 7 as the source of vibration, at which it was not possible to dispose parts because of their susceptibility to vibration. This achieves centralization of mass, which is particularly suited to offroad vehicles, in which vehicle operability is at a premium. Moreover, the capacitor 38 can be supported at a location downward of the throttle body 10. This allows the capacitor 38 to be disposed in the space S which is surrounded by the throttle body 10, the cylinder 8, and the crankcase 9 and which has not so far been utilized much. This results in enhanced space utilization efficiency in layout of the electric component.

Further, the capacitor 38 is supported by making use of the throttle body cover 37 that covers the left and right sides of the throttle body 10. This eliminates the need for a support member dedicated to the purpose. As a result, the number of parts used can be reduced and the support structure can be simplified. Moreover, the capacitor 38 can be fixed in an elastically supported condition by simply inserting the tongue 54 and the bifurcate portion 64 of the holder portions 53, 63, respectively, that form part of the throttle body cover 37 into the slit 73 formed in the band portion 72 of the elastic holder 71 in the capacitor 38. This facilitates support and fixing of the capacitor 38.

In addition, the capacitor 38 is accommodated inside the holder portions 53, 63 on the left and right so as to be enclosed thereby. This blocks off heat from the engine 7 relative to the capacitor 38. The support structure is therefore exactly right for the capacitor 38 that is susceptible to heat.

The present invention is not limited to the aforementioned embodiment and can be implemented in various manners without departing from the spirit thereof. For instance, the electric component to which the present invention is applied is not limited to the capacitor. Rather, the present invention is applicable to any component that is susceptible to heat and vibration. Use of the throttle body cover 37 is not mandatory and the capacitor may be directly mounted to the throttle body. Either the left cover 50 or the right cover 60 may only be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric component support structure for a motorcycle, the motorcycle comprising:

an intake path for supplying air for an engine; and a throttle body having a built-in throttle for adjusting an amount of air supplied to the intake path, the throttle body being connected to the intake path via an insulator formed from an elastic body, wherein the throttle body is connected to an air cleaner fixed to a vehicle body via a connecting tube formed of an elastic body, wherein an electric component is supported by the throttle body, and wherein the electric component includes a capacitor covered with a holder formed of an elastic material; and wherein the holder is mounted to the throttle body, which supports the electric component on the throttle body.

2. The electric component support structure according to claim 1, wherein the capacitor is accommodated at a lower portion on an inside of the holder and is supported at a position downward of the throttle body.

3. The electric component support structure according to claim 1, wherein the holder is formed from a coating of a rubber and integrally covers a capacitor main body of the capacitor in order to provide isolation from vibration.

4. The electric component support structure according to claim 1, wherein the holder includes a thick-wall band portion that protrudes downwardly and is integrally formed therewith, the band portion including a slit that penetrates therethrough in a lateral direction of the thick wall.

5. The electric component support structure according to claim 1, wherein the throttle body is covered with a throttle body cover from a left- and right-hand side.

6. The electric component support structure according to claim 5, wherein the throttle body cover is formed from a resin.

7. The electric component support structure according to claim 5, wherein an upper portion on a rear side of the throttle body cover extends along a lower end of a main frame of the motorcycle, and the throttle body cover is removable to a left and right without allowing the cover to interfere with the main frame.

8. The electric component support structure according to claim 1, wherein the electrical component is cylindrical in shape and has an axis parallel to an axis of a pivot of the throttle.

9. An electric component support structure for a motorcycle, the motorcycle comprising:

an engine disposed between a front wheel and a rear wheel, the engine including a crankcase disposed downward and a cylinder extending upwardly of the crankcase, the cylinder including an intake port opening rearwardly from an upper portion thereof, the intake port being connected to a throttle body via an insulator formed of an elastic body, the throttle body being connected to an air cleaner box via a connecting tube formed of an elastic body, wherein an electric component is supported downwardly of the throttle body, and wherein the throttle body includes a throttle body cover mounted so as to cover an outside of the throttle body; and the electric component is supported on the throttle body cover.

10. The electric component support structure according to claim 9, wherein the electrical component is cylindrical in shape and has an axis parallel to an axis of a pivot of the throttle.

11. The electric component support structure according to claim 9, wherein the throttle body cover is previously divided into left- and right-hand side halves, and the left- and right-hand side halves are mounted so as to sandwich the throttle body;

wherein the left- and right-hand side halves are connected together at a connection downward of the throttle body during mounting; and wherein the connection is inserted into a slit formed in the electric component so that the electric component is supported.

12. The electric component support structure according to claim 9, wherein the throttle body is covered with a throttle body cover from a left- and right-hand side.

13. The electric component support structure according to claim 9, wherein the throttle body cover is formed from a resin.

14. The electric component support structure according to claim 9, wherein an upper portion on a rear side of the throttle body cover extends along a lower end of a main frame of the motorcycle, and the throttle body cover is removable to a left and right without allowing the cover to interfere with the main frame.

15. An electric component support structure for a motorcycle, the motorcycle comprising:

an engine disposed between a front wheel and a rear wheel, the engine including a crankcase disposed downward and a cylinder extending upwardly of the crankcase, the cylinder including an intake port opening rearwardly from an upper portion thereof, the intake port being connected to a throttle body via an insulator formed of an elastic body, the throttle body being connected to an air cleaner box via a connecting tube formed of an elastic body, wherein an electric component is supported downwardly of the throttle body, wherein the electric component is a capacitor that is accommodated at a lower portion on the inside of a holder and is supported at a position downward of the throttle body.

16. The electric component support structure according to claim 15, wherein the throttle body includes a throttle body cover mounted so as to cover an outside of the throttle body; and wherein the electric component is supported on the throttle body cover.

17. The electric component support structure according to claim 15, wherein the holder is formed from a coating of a rubber and integrally covers a capacitor main body of the capacitor in order to provide isolation from vibration.

18. The electric component support structure according to claim 15, wherein the holder includes a thick-wall band portion that protrudes downwardly and is integrally formed therewith, the band portion including a slit that penetrates therethrough in a lateral direction of the thick wall.

19. The electric component support structure according to claim 15, wherein the throttle body is connected to an air cleaner fixed to a vehicle body via a connecting tube formed of an elastic body.

* * * * *